United States Patent [19]

Frey et al.

[11] Patent Number: 4,459,513

[45] Date of Patent: Jul. 10, 1984

[54] HIGH PRESSURE SODIUM VAPOR LAMP HAVING RESISTANCE HEATER MEANS

[75] Inventors: Robert G. Frey, Strongsville; Charles I. McVey, Shaker Heights, both of Ohio

[73] Assignee: General Electric Company, Schenectady, N.Y.

[21] Appl. No.: 403,901

[22] Filed: Jul. 30, 1982

[51] Int. Cl.[3] ..... H05B 41/16

[52] U.S. Cl. ..... 315/47; 315/46; 315/73; 315/108; 315/116

[58] Field of Search ..... 315/46, 48, 49, 50, 315/56, 73, 115–117, 108, 47

[56] References Cited

U.S. PATENT DOCUMENTS 3,851,207 11/1974 McVey ..... 315/49

4,182,976 1/1980 Larson ..... 315/49

*Primary Examiner*—Eugene R. LaRoche

*Attorney, Agent, or Firm*—John F. McDevitt; Philip L. Schlamp; Fred Jacob

[57] ABSTRACT

An improved high pressure sodium vapor lamp is described having resistance heater means contained within a tubular light-transmitting ceramic envelope that further contains a reservoir of sodium-mercury amalgam in excess of the quantity vaporized during lamp operation and which are supplied by electric current other than the lamp current responsive to a rise in the lamp operating voltage to reduce the quantity of amalgam being vaporized during lamp operation to help maintain said lamp operation at a relatively constant voltage. In a preferred embodiment, said resistance heater means comprises a refractory metal coil wound around the tungsten shank at one thermionic electrode and electrically insulated therefrom, with said thermionic electrode including a tubular metal inlead serving as the amalgam reservoir, and with the electric current being supplied at a lower value to said refractory metal coil than being supplied to said thermionic electrode.

12 Claims, 3 Drawing Figures

Fig. 1
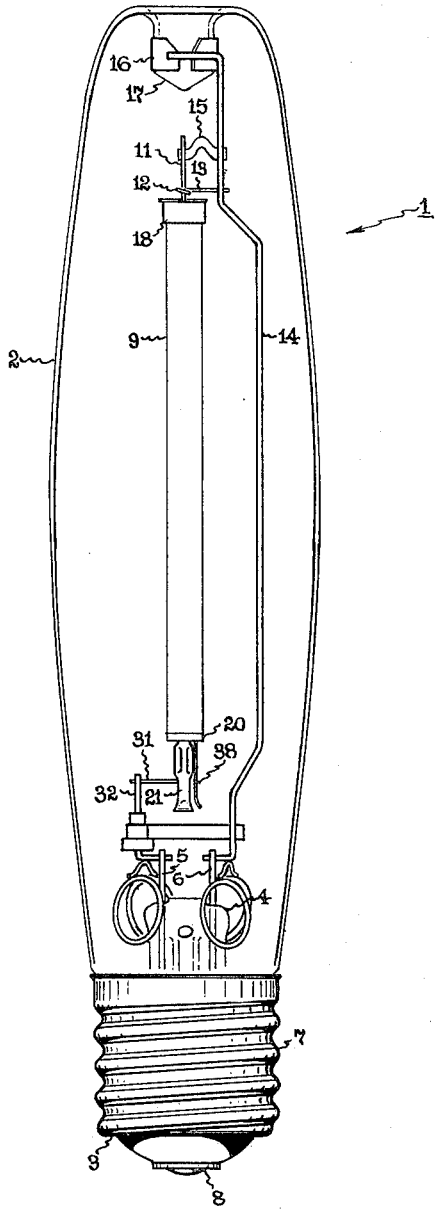
Fig. 2
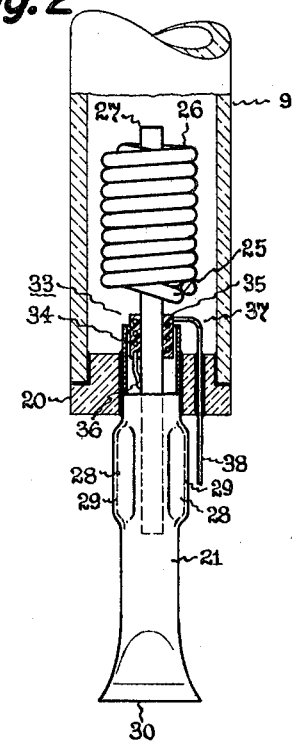
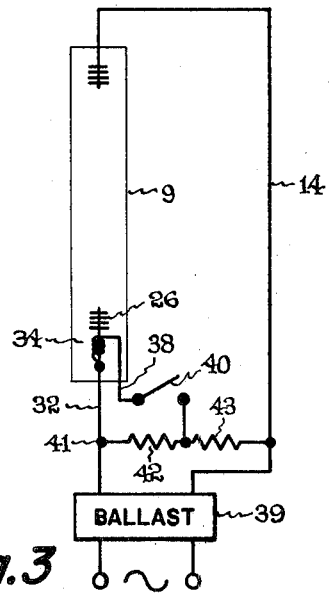
Fig. 3

HIGH PRESSURE SODIUM VAPOR LAMP HAVING RESISTANCE HEATER MEANS

RELATED PATENT APPLICATIONS

In our U.S. patent application Ser. No. 403,899, filed concurrently with the present application, there is described a high pressure sodium vapor lamp including related resistance heater means.

In our U.S. patent application Ser. No. 403,900, also filed concurrently with the present application, there is described another high pressure sodium vapor lamp including related resistance heater means.

BACKGROUND OF THE INVENTION

Resistance heater means are already known as the starting aid in high pressure sodium vapor lamps. For example, in U.S. Pat. No. 4,001,634, there is described thermal starter means for this type lamp in the form of a bimetal switch which is located outside the conventional ceramic arc tube and which upon opening responsive to the applied electric current generates an inductive voltage pulse said to be sufficient to ionize the starting gas in the arc tube and start lamp operation. It is also known that the color temperature of high pressure sodium vapor lamp operation varies undesirably with the overall lamp color point depending to a significant degree on the temperature of the cold spot in the arc tube where amalgam condensation takes place. The "cold spot" temperature controls amalgam vapor pressure inside the arc tube thereby increasing or decreasing the amount of vaporized amalgam which produces the visible lamp emission as well as the color of said lamp emission.

Resistance heater means have also been located inside the arc tube of the sodium vapor lamp to stabilize the cold spot temperature and amalgam vapor pressure which tend to rise during lamp operating life. The undesired variation is attributable to operating voltage rise that eventually reaches the ballast sustaining voltage and determines the end of lamp life in this type lamp. Said resistance heater means is supplied with the lamp current which inherently decreases with an increase in the lamp operating voltage and reduces supplemental heating of the amalgam reservoir as the stabilizing mechanism for improved lamp operation. A representative sodium vapor lamp incorporating this type resistance heater means is described in U.S. Pat. No. 3,851,207, wherein the heater element simply comprises an integral part of the thermionic electrode. Understandly, the power consumed by such heater means reduces the lamp operating efficiency and this power loss will be greatest at the initial lamp operation. Since the present lamp designs exhibit only a 20 volt rise after 15,000 hours of lamp operation, such loss in lamp operating efficiency seems excessive especially when encountered before any voltage rise takes place.

Accordingly, it would be desirable to provide improved supplemental heating means whereby the vaporized amalgam in this type lamp can be adjusted to compensate for the inherent operating voltage rise. It would also be desirable to do so in a manner which does not add significant cost to the lamp design or its cost of manufacture by requiring a modification in the lamp ballast circuitry.

SUMMARY OF THE INVENTION

It has now been discovered that resistance heating means located within the ceramic arc tube adjacent the amalgam reservoir in said electrode structure and supplied with electric current independent of the lamp current can serve to reduce the quantity of amalgam being vaporized during lamp operation responsive to a rise in the lamp operating voltage and thereby help maintain said lamp operation at a relatively constant voltage. By independently heating the arc tube in this manner during lamp operation, no loss in lamp operating efficiency should result due to some power being consumed for supplemental heating at the expense of the lamp operating discharge. The present improvement should also enable lower wattage lamps of this type to be constructed since conventional lamps without supplemental electrode heating have a minimum wattage requirement used to sustain the lamp operating discharge.

Basically, the presently improved high pressure sodium vapor lamp construction includes a tubular light-transmitting ceramic envelope containing a reservoir of sodium-mercury amalgam in excess of the quantity vaporized during lamp operation and themionic electrodes being sealed into its ends, wherein the improvment comprises further including within said ceramic envelope resistance heater means disposed adjacent the amalgam reservoir which are supplied with electric current other than the lamp current to reduce the quantity of amalgam being vaporized during lamp operation responsive to a rise in the lamp operating voltage and thereby help stabilize lamp operation at a relatively constant voltage. A circuit means to operate such supplemental heating of the arc tube can be located within the outer vitreous envelope customarily enclosing said arc tube so as not to require any further modification in the conventional lamp circuitry. For example, a resistive network can be operated within said outer envelope which heats a normally closed thermally responsive switch that is connected to the heating element of the resistance heater means contained within the arc tube whereby automatic interruption of the electric current being supplied to said resistance heater means occurs during the lamp operation.

In a preferred embodiment, the presently improved high pressure sodium vapor lamp comprises a tubular light-transmitting ceramic tube having closures and thermionic electrodes in its ends, and containing a reservoir of sodium-mercury amalgam in excess of the quantity vaporized during lamp operation along with inert gas, such as xenon, to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube mounted on a metal shank, wherein the improvement comprises resistance heater means being disposed adjacent said metal shank and supplied with lower electrical current than the lamp current to decrease the quantity of amalgam being vaporized during said lamp operation responsive to a rise in the lamp operating voltage. The thermionic electrode structures employed in said preferred lamp embodiment comprise refractory metal coils wound around said tungsten shank. The resistance heater means includes a refractory metal coil wound around the tungsten shank of one thermionic electrode but electrically insulated therefrom and which is supplied with less current than the current supplied to said electrode. One end of said refractory metal coil is electrically connected by direct joinder to said tungsten shank with the other end of said coil being electrically connected to an inlead emerging from the ceramic tube. The preferred lamp embodiment further includes an outer evacuated light-transmitting vitreous envelope surrounding said ceramic tube having a stem press seal at one end through which extend a pair of inleads electrically connected to said thermionic electrodes along with inlead means for the resistance heater means. The inlead electrically connected to one end of the refractory metal coil providing the resistance heating further extends to the circuit means in the outer vitreous envelope for independent supply of electrical current thereto.

BRIEF DESCRIPTION OF THE DRAWINGS

FIG. 1 shows a high pressure sodium vapor lamp embodying the presently improved resistance heating means;

FIG. 2 is an enlarged detailed view of the exhaust tube electrode member incorporating said resistance heater means; and FIG. 3 is a schematic electrical circuit to operate said resistance heating means during lamp operation.

DETAILED DESCRIPTION OF THE PREFERRED EMBODIMENTS

Referring to FIG. 1, a high pressure sodium vapor lamp 1 corresponding to a 400 watt size is illustrated which comprises vitreous outer envelope 2 having a standard mogul screw base 3 attached to one end and comprising a reentrant stem press seal 4 through which extend, in conventional fashion, a pair of relatively heavy lead-in conductors 5 and 6 whose outer ends are connected to the screw shell 7 and eyelet 8 of the base. The inner envelope or arc tube 9 centrally located within said outer envelope comprises a length of light-transmitting ceramic tubing, preferably polycrystalline alumina ceramic which is translucent or which can be single crystal alumina which is clear and transparent. The upper end of the arc tube is closed by a conventional ceramic enclosure through which extends a niobium inlead wire 11 hermetically sealed. Said inlead supports the upper electrode which can be generally similar to the lower electrode illustrated in FIG. 2. A preferred upper end closure and electrodes for structure is described in U.S. Pat. No. 4,034,252, also assigned to the assignee of the present invention. The external portion of inlead 11 passes through a loop 12 and transverse support wire 13 attached to a side rod 14. This arrangement allows for thermal expansion of the arc tube during lamp operation when the lower end seal is rigidly fixed in place, and a resilient metal ribbon 15 assures continued good electrical connection. A metal reflector band 18 may be desirable around the upper end of the arc tube to help in maintaining a higher electrode operating temperature, particularly in smaller sizes of lamps such as 250 watts or less. The lower end closure in electrode support assembly 20 for said lamp has a central aperture through which extends a thin-walled niobium tube 21 serving as an exhaust tube and as an inlead. Said tube extends but a short distance through the ceramic end closure and is hermetically sealed therethrough by sealing frit in the conventional manner. The closed arc tube is supported in the outer envelope by a connector 31 which is welded across from tubular inlet 21 to a support rod 32 joined to lead-in conductor 5. A second lead-in conductor 38 shown emerging from said lower end closure and connected to the resistance heater means contained within the arc tube further extends to the circuitry later described in FIG. 3 to provide an independent current source from the lamp current. Also not shown in the present drawing is a filling of xenon gas within the arc tube to help establish the lamp operating discharge.

The present invention resides in the resistance heater means itself which is depicted in greater detail for the lower electrode structure and the electrode support assembly therefor as shown in FIG. 2. Specifically, said electrode proper comprises two layers of tungsten wire 25 and 26 wound around the distal end of a tungsten shank 27 and located in the ceramic envelope. The shank extends far enough down into tube or inlead 21 so that it can be securely locked in place by deforming the tube in a place outside the ceramic envelope by pinching the shank over an appreciable length. Preferably, the deformation is at an intermediate point in the tube which leaves a portion beyond it adequate to serve as a reservoir for excess amalgam. The illustrated crimp, sometimes known as a butterfly crimp, is of such a character that it pinches the shank along the entire length of the flattened portions or wings 28. At the same time, restrictive channels 29 are left on both sides of the shank which communicate with the outer portion of the exhaust tube up to the tip 30. They allow passage of the sodium-mercury amalgam in vapor form but will prevent its movement as a liquid under ordinary operating conditions, even when a lamp is upended. Depicted resistance heater means 33 comprises a refractory metal coil 34 wound around the tungsten shank 27 and electrically insulated therefrom with ceramic sealing frit 35. One end 36 of said refractory metal coil 34 is directly secured to the tungsten shank 27, such as by welding and the like, with the remaining end 37 of said refractory metal coil being electrically connected to an inlead 38 emerging from said arc tube.

A schematic electrical circuit having representative components to automatically operate the present resistor heating means during lamp operation is shown in FIG. 3. As depicted, the circuit connections to the upper and lower thermionic electrodes from conventional ballast member 39 are made by conductors 14 and 32, respectively, in a manner permitting electrical current at a lower value to be supplied to the refractory metal coil 34 of the present resistance heater means at the same time. This occurs, as previously explained, by having one end of the refractory metal coil directly connected to the tungsten shank of lower thermionic electrode 26 with the remaining end of said refractory metal coil being electrically connected to inlead 38. By further terminating said inlead 38 as shown to the electrical conductor 14, there is provided a circuit means to operate said refractory metal coil 34 after the lamp operating discharge has been established in the customary manner. More particularly, there is positioned in the outer vitreous envelope of said lamp a conventional normally closed thermally responsive switch 40 sufficiently proximate to a resistor bridge network 41 also located within said outer vitreous envelope for heating by the resistor components 42 and 43. A rise in the lamp operating voltage increase the heat being generated by said resistors 42 and 43 to open the associated switch, which can be of a conventional bimetal construction thereby terminating a supply of electric current to the resistance heater means.

It will be apparent from the foregoing description that resistance heater means have been provided for high pressure sodium-vapor type lamps which is generally useful. It will be further apparent to those skilled in the lamp art, however, that said improvement can be incorporated in other type sodium-vapor lamps than above specifically disclosed. For example, both designs utilizing additional gettering and starting aids can use the present resistance heating means to the same advantage. Accordingly, it is intended to limit the present invention only by the scope of the following claims.

What we claim as new and desire to secure by United States Letters Patent is:

1. An improved high pressure sodium vapor lamp having a tubular light-transmitting ceramic envelope containing a reservoir of sodium-mercury amalgam in excess of the quantity vaporized during lamp operation and thermionic electrodes being sealed into its ends, wherein the improvement comprises further including within said ceramic envelope resistance heater means including a resistive heating element disposed adjacent to the amalgam reservoir and electrically connected with respect to said electrodes to be supplied by electric current other than the lamp current responsive to a rise in the lamp operting voltage by operation of associated-thermal switch means to reduce the quantity of amalgam being vaporized during lamp operation and help maintain said lamp operation at a relatively constant voltage.

2. An improved lamp as in claim 1 wherein the thermionic electrodes comprise refractory metal coils wound around a tungsten shank.

3. An improved lamp as in claim 2 wherein said resistance heater means comprises a refractory metal coil wound around the tungsten shank of one thermionic electrode and electrically insulated therefrom.

4. An improved lamp as in claim 3 wherein said refractory metal coil is electrically connected at one end to said tungsten shank and electrically connected at the other end of an inlead emerging from the ceramic envelope.

5. An improved high pressure sodium vapor lamp comprising:

(a) a light-transmitting ceramic tube having a thermionic electrode sealed into each end and a reservoir of sodium-mercury amalgam in excess of the quantity vaporized during lamp operation along with inert gas to facilitate starting;

(b) an evacuated outer light-transmitting vitreous envelope surrounding said ceramic tube having a stem press seal at one end through which extends a pair of inleads electrically connected to said thermionic electrodes;

(c) one of said thermionic electrodes comprising a tubular metal inlead conductor hermetically sealed to said ceramic tube and extending externally therefrom to provide said amalgam reservoir at its external end and said tubular metal inlead being joined at its opposite end to an electrode located within said ceramic tube mounted on a metal shank;

(d) wherein the improvement comprises resistance heater means including a resistive heating element being disposed adjacent the amalgam reservoir and electrically connected with said electrodes to be supplied by electric current other than the lamp current responsive to a rise in the lamp operating voltage by operation of associated thermal switch means to reduce the quantity of amalgam being vaporized during lamp operation and thereby help maintain said operation at relatively constant voltage.

6. An improved lamp as in claim 5 wherein both thermionic electrodes comprise refractory metal coils wound around a tungsten shank.

7. An improved lamp as in claim 6 wherein said resistance heater means comprises a refractory metal coil wound around the tungsten shank of one thermionic electrode and electrically insulated therefrom.

8. An improved lamp as in claim 7 wherein said refractory metal coil is electrically connected at one end to said tungsten shank and electrically connected at the other end to an inlead emerging from the ceramic tube.

9. An improved method of operating a high pressure sodium vapor lamp having a tubular light-transmitting ceramic envelope containing a reservoir of sodium-mercury amalgam in excess of the quantity vaporized during lamp operation and thermionic electrodes being sealed into its ends which comprises:

(a) applying a first electric current to the thermionic electrodes sufficient to produce the lamp operating discharge; and (b) applying a second electric current independent from said first electric current to resistance heating means disposed in said ceramic envelope so as to reduce the quantity of amalgam being vaporized during lamp operation responsive to a rise in the lamp operating voltage and thereby help maintain said lamp operation at a relatively constant voltage.

10. An improved method as in claim 9 wherein the electric current applied to the resistance heating means is applied before the lamp operating discharge is established.

11. An improved method as in claim 9 wherein the second electric current is applied by thermally responisve circuit means.

12. An improved method of operating a high pressure sodium vapor lamp having a light-transmitting ceramic tube with closures and thermionic electrodes at each end and containing a reservoir of sodium-mercury amalgam in excess of the quantity vaporized during lamp operation along with xenon gas to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube on a refractory metal shank which comprises:

(a) applying a first electric current to the thermionic electrode sufficient to produce the lamp operating discharge;

(b) actuating thermally responsive circuit means to continuously apply a second electric current independent from said first electric current to resistance heating means disposed in said ceramic tube adjacent said refractory metal shank; and (c) reducing the amount of second electric current sufficient to reduce the quantity of amalgam being vaporized during lamp operation responsive to a rise in the lamp operating voltage.

* * * * *